United States Patent [19]

Heimann et al.

[11] Patent Number: 4,813,971

[45] Date of Patent: Mar. 21, 1989

[54] USE OF CYCLIC ESTERS OF SULFUROUS ACID IN THE DYEING OF POLYAMIDE TEXTILE MATERIALS

[75] Inventors: Sigismund Heimann, Ludwigshafen; Michele Vescia, Limburgerhof; Attila Bereck, Maxdorf; Hermann Sulz, Bobenheim-Roxheim; Ingrid Steenken, Bad Durkheim, all of Fed. Rep. of Germany

[73] Assignee: BASF Aktiengesellschaft, Ludwigshafen, Fed. Rep. of Germany

[21] Appl. No.: 153,706

[22] Filed: Feb. 4, 1988

[30] Foreign Application Priority Data

Feb. 11, 1987 [DE] Fed. Rep. of Germany ..... 3704125

[51] Int. Cl.[4] ..... C09B 67/00; C07D 327/04

[52] U.S. Cl. ..... 8/575; 8/576; 8/589; 8/917; 8/924; 8/610; 526/917; 549/40; 558/59

[58] Field of Search ..... 8/575, 576, 589, 917, 8/924, DIG. 21, 610; 526/917; 549/40; 558/59

[56] References Cited

U.S. PATENT DOCUMENTS

| | | | |
|---|---|---|---|
| 3,565,571 | 2/1971 | Reese et al. | 8/575 |
| 3,980,428 | 9/1976 | Fabbri et al. | 8/578 |
| 4,252,531 | 12/1981 | Daeuble et al. | 8/531 |
| 4,350,494 | 9/1982 | Scheidegger et al. | 8/636 |
| 4,519,805 | 5/1985 | Koci | 8/610 |

*Primary Examiner*—Paul Lieberman
*Assistant Examiner*—Helene Kirschner
*Attorney, Agent, or Firm*—Oblon, Fisher, Spivak, McClelland & Maier

[57] ABSTRACT

Textile materials made of natural or synthetic polyamides or mixtures thereof are dyed in the presence of a cyclic ester of sulfurous acid with an aliphatic 1,2-diol in place of a customary pH regulant.

4 Claims, No Drawings

USE OF CYCLIC ESTERS OF SULFUROUS ACID IN THE DYEING OF POLYAMIDE TEXTILE MATERIALS

The present invention relates to the use of a cyclic ester of sulfurous acid with an aliphatic 1,2-diol, in the place of a conventional pH regulant, as an assistant in the dyeing of textile materials made of natural or synthetic polyamides or mixtures thereof, and to a process for dyeing these textile materials in the presence of a cyclic ester of sulfurous acid with an aliphatic 1,2-diol.

It is known that in the dyeing of wool or nylon a high levelness is obtainable by reducing the rate of dyeing to such an extent as to produce a uniform rate of dye uptake. For instance, the rate of dyeing can be affected by controlling the rate of heating or by regulating the pH. Depending on the pH of the dyeing liquor, different partition equilibria become established between the dye, the textile material to be dyed, and the aqueous medium. In altering the ph from weakly alkaline to acid under controlled conditions, this equilibrium is gradually shifted in favor of the fiber, so that the dye can go on to the fiber at a highly uniform rate, thereby decisively improving the levelness of the dyeing.

According to German Laid-Open Application DOS No. 2,700,153, a possible procedure comprises introducing the material to be dyed into a bath at pH 6–12 and then reducing the pH to 3–7 by adding inorganic acids, such as nitric, hydrochloric or sulfuric acid. The same effect can also be obtained for example by using acidic salts. The disadvantage here is that high local acid concentrations can appear at the site where the acid is dripped in, ie. that substantial pH differences arise in the dyebath. In addition, the continuous metered addition of acid requires special apparatus.

By using organic esters which, on heating, gradually become cleaved and release an acid, it is possible to control the pH in such a way that everywhere in the bath substantially the same pH exists at any time. For instance, British Pat. No. 716,990 discloses a process for dyeing wool and nylon using esters of organic acids, such as diethyl tartrate, ethyl acetate or diethyl oxalate, as pH regulants. The dyeing is started at pH 8 and the organic ester, which becomes cleaved on reaching the boil, is then added. The acid which is released gradually reduces the pH of the dyebath to about pH 6.0.

Furthermore, German Laid-Open Application DOS. No. 2,354,728, for example, discloses the use of lactones, in particular butyrolactone, as pH regulants in the dyeing of textile materials made of natural and synthetic polyamides. German Laid-Open Application DOS No. 2,812,039 discloses that esters of saturated C2–C4-carboxylic acids having a tertiary amino group in the 2-position are used as pH regulants. A noteworthy representative thereof is in particular ethyl triethanolaminetriacetate, which has come to be important in industry.

The disadvantage of these existing processes, where pH regulants are used, is that in some instances the pH at the end of the dyeing is not low enough to ensure complete exhaustion of the dyes used. Complete exhaustion is important, in particular in the dyeing of dark shades, on account of the problem of colored effluent.

European Pat. No. 55,694 discloses using for example propylene glycol sulfite as a vatting accelerant in the dyeing and printing of cellulose materials and cellulose/polyester blend fabrics. There is no mention in this prior art of a specific use as pH regulant.

It is an object of the present invention to provide a pH regulant for the dyeing of wool or nylon whereby it is possible to obtain a low pH, of ideally from 5 to about 4.0.

We have found that this object is achieved by using a cyclic ester of sulfurous acid with an aliphatic diol in the dyeing of polyamide textile materials and in a process therefor.

The present invention accordingly provides a method of using a compound of the formula I

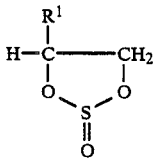

I where $R^1$ is hydrogen or alkyl of 1 to 4 carbon atoms, as an assistant, in particular as a pH regulant having an additional bleaching action, in the dyeing of a textile material made of natural or snythetic polyamide or a mixture thereof with an anionic dye in an aqueous liquor in an amount from 0.25 to 5.0 g/l of liquor.

The present invention also provides a process for dyeing a textile material made of a natural or synthetic polyamide or a mixture thereof with an anionic dye in an aqueous liquor in the presence of a cyclic ester of sulfurous acid of the formula I in an amount from 0.25 to 5.0 g/l of liquor.

The surprising effect is that in the presence of the abovementioned ester of sulfurous acid, the dyebath pH is shifted in the course of the dyeing at a uniform rate into the acid range, producing a pH from about 5.0 to 4.0 by the end of the dyeing. Brilliant dyeings of excellent uniformity are obtained with virtually complete exhaustion of the dye. In addition to acting as a pH regulant, the cyclic ester of sulfurous acid also has an advantageous bleaching action.

In detail, the present invention can be described as follows:

An alkyl $R^1$ in the formula I is in particular methyl, ethyl or propyl, methyl being preferred. A particularly preferred compound of the formula I is ethylene glycol sulfite (EGS). The compounds of formula I are known; they are clear liquids which are advantageously added direct to the dyebath.

The textile material made of a natural or synthetic polyamide or a mixture thereof and to be dyed according to the invention comprises wool and silk as examples of natural polyamides, existing synthetic polyamide materials, such as nylon 6 and nylon 66, or a commercial mixture of wool and a synthetic polyamide.

The material to be dyed can be present for example as a staple fiber, yarn or woven or knitted fabric.

To dye the abovementioned textile materials, use is made of the customary anionic dyes or dye mixtures, such as 1:2 metal complex, reactive or acid dyes, in particular those dyes which contain sulfo groups, although sulfonamide groups are also acceptable in the metal complex dyes. Suitable dyes also include those of the afterchroming type.

If acid or acid fulling dyes are to be used, it is advisable to test beforehand, if necessary, whether they are stable to reduction.

The compound of the formula I to be used according to the invention is advantageously added to the aqueous liquor in an amount from 0.25 to 5.0 g/l. The preferred amounts range from 0.5 to 2.0 g/l in the case of wool and from 0.25 to 0.5 g/l in the case of nylon.

The dyeing assistant according to the invention is advantageously added direct to the dyebath at room temperature. However, the addition can also take place during the dyeing, for example after the temperature has been raised to 80° or 100° C.

In other respects, the dyeings are basically carried out under customary conditions in aqueous liquors from 5:1 to 30:1, preferably from 10:1 to 20:1, in length.

The aqueous liquor may contain customary additives and assistants as described for example in general handbooks and manuals, such as A. Chwala, Handbuch der Textilhilfsmittel, 1977.

For instance, possible additives for the dyebath are the customary leveling assistants, such as fatty alcohol polyglycol ethers, fatty amine polyglycol ethers, alkylphenol polyglycol ethers, fatty alkyl sulfates or alkylbenzenesulfonates. Further additives are for example salts, such as ammonium sulfate, sodium sulfate or sodium acetate, and also defoamers, wetting agents, dispersants and the like.

The pH of the aqueous liquor is set at the beginning of the dyeing operation, in general to 7–9, preferably 7–8, for which ammonia, alkali metal hydroxide or carbonate, preferably of sodium or potassium, an organic base, in particular a trialkylamine or trialkanolamine, such as triethanolamine, can be used as the base.

As mentioned above, the dyeing according to the invention is carried out in an otherwise conventional manner, except that, according to the invention, a compound of the formula I is added instead of an acid or acid donor. The ready-prepared dyebath is entered at room temperature with the material to be dyed and heated to the suitable dyebath temperature from 80° to 100° C., and the dyeing is completed in a conventional manner.

In other cases it can be advantageous to add the pH regulant to be used according to the invention only at elevated temperatures.

An advantageous procedure accordingly comprises carrying out a process for dyeing a textile material made of a natural or synthetic polyamide or a mixture thereof with an anionic dye in an aqueous liquor in the presence of the customary assistants by adding to the dyebath a cyclic ester of sulfurous acid of the formula I in an amount from 0.25 to 5.0 g/l of liquor, introducing the material to be dyed into the liquor at from 20° to 60° C., and completing the dyeing at from 80° to 110° C., preferably at around 100° C.

The cyclic ester can also be added in the course of the heating-up phase at from 80° to 100° C.

In general, the dyeing is complete at from 80° to 110° C. in the course of from 1 to 2 hours, during which the advantageous pH range from 5 to 4.0 becomes established.

In the preferred embodiments, the liquor is brought to pH 7–9, preferably pH 7–8, before the compound of the formula I is added.

Noteworthy advantages are in particular that, in the presence of the cyclic ester of sulfurous acid of the formula I, anionic dyes go on to the fiber slowly and evenly. This is particularly advantageous for wool with or without an antifelting finish and nylon. The relatively low pH at the end of the dyeing ensures good bath exhaustion. The pH which has become established for example after a dyeing time at 100° C. of 1 hour remains constant even in the event of the dyeing time being extended; this fact is important if a shade adjustment of the dyeing obtained has to be carried out. The compound to be used according to the invention is distinguished from existing compounds used as pH regulants in industry in that the dyeings produced in its presence are in many cases deeper and more brilliant.

In addition to acting as an acid donor, the cyclic sulfite ester reduces the yellowing of wool in a boiling dye liquor, thereby increasing the brilliance of the dyeings. It is therefore usually possible to dispense with a costly, time-consuming prebleach, for example using peroxides of bisulfites. In consequence it is possible, because of the spreading effect to produce pastels with dyes of higher fastness although, lower brilliance.

Wool which has been given an antifelting finish has a high substantivity for dyes, since the chlorination associated with the finish serves to loosen the structure of the wool or, if the finish comprises for example a cationic polymer (as in the Hercosett process), the dyes are subjected to a strong electrostatic attraction. In many cases this can result in unlevel dyeings. Using the process according to the invention it is possible to obtain level dyeings on wool having been given such an anitfelting finish, advantageously by bringing the dyeing liquor at the start of dyeing to a pH from 8 to 9.

Using the esters according to the invention, dyeing can be carried out not only in hard but also in soft water. A further advantage is that wools of different alkalinities, as caused by various wash processes or pretreatments, can be dyed using the same amount of EGS. The course of the pH during the dyeing of wools having different residual alkali contents is almost identical in every case and thus provides a guarantee for a controlled rate of dyeing leading to level results.

In the Examples which follow, the percentages by weight are always on weight of fiber.

EXAMPLES

I. Dyeing of wool with a mixture of 1:2 metal complex and reactive dyes

General method:

After addition of the dyes described in more detail below, of 1% by weight of an ethoxylated oleylamine as leveling assistant, of 5% by weight of ammonium sulfate and 1 g/l of ethylene glycol sulfite (EGS), the dyeing liquor is brought with ammonia to pH 7.5–8.0. The wool material is introduced at 40° C. into the liquor at a liquor ratio (LR) of 20:1. The temperature is raised to 100° C., the dyeing is continued at that temperature for 60 min, and the wool material is then rinsed.

For comparison, parallel dyeings are carried out with 1 g of triethanolaminetriacetate as described in DE No. 2,812,039 per l of liquor in place of EGS.

The dyes used are present in commercial form. Dyebath exhaustion is checked by dyeing (60 min, 100° C.) from the used liquor.

General method I is followed to prepare the following dyeings:

EXAMPLE 1

Dyeings of merino wool tops having an average individual fiber fineness of 22.1 μm, with 0.97% by weight of a metal complex dye of the following constitution:

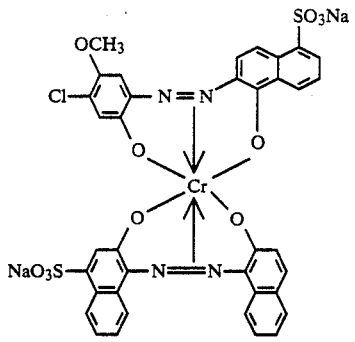

0.6% by weight of a reactive dye of the following structure:

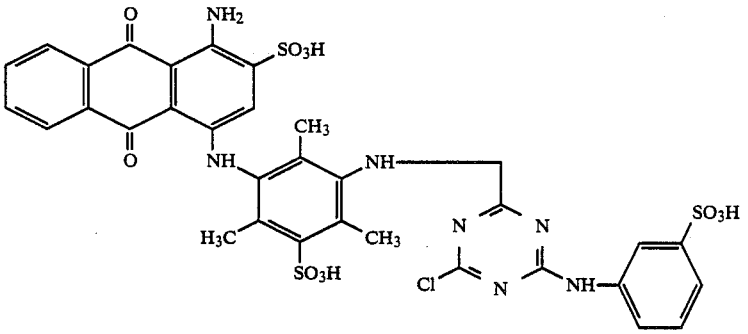

and 0.2% by weight of the dye of C.I. No. 61,211. Using EGS, the final pH is 5.2.

The dyeing in the presence of EGS as against triethanolaminetriacetate, where the final pH is 5.6, is deeper and more brilliant.

EXAMPLE 2

Dyeing of wool yarn (28/2) with 0.7% by weight of a dye of the following constitution:

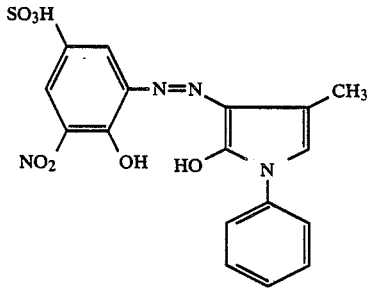

in the form of a chromium (1:2) complex and 0.1% by weight of the dye of C.I. No. 18,762 and 0.95% by weight of the reactive dye of C.I. No. 25,810.

Dyeing with EGS produces a final pH of 5.0, as against the 5.5 in the comparative test, and the dyeing is more brilliant and more completely exhausted.

II. Dyeing of wool using acid dyes

General method:

The material to be dyed is introduced at 40° C. and an LR of 20:1 into a dyebath containing 5% by weight of sodium sulfate and 1 g/l of EGS. The pH is adjusted to 7.5 with ammonia.

For comparison, dyeings are carried out in a liquor containing 5% by weight of sodium sulfate and having a pH of 5.0, set with acetic acid.

The liquor is raised to 70° C. in the course of 20 min, then left at 70° C. for 20 min, and then raised to 98° C. in the course of 20 min. The dyeing is completed at 98° C. in the course of 60 min and subsequently rinsed.

General method II is used to prepare the following dyes:

EXAMPLE 3

Dyeing of wool tops (27.0 μm) with 0.12% by weight of the dye of C.I. No. 23,266. The presence of EGS results in a brighter and more brilliant dyeing than that with acetic acid.

EXAMPLE 4

Dyeing of wool yarn (48/2) with 0.09% by weight of the dye of C.I. No. 50,320. The dyeing with EGS is substantially deeper and more brilliant than that with acetic acid.

III. Dyeing of wool with reactive dye

General method:

After addition of 4% by weight of ammonium sulfate, of 10% by weight of sodium sulfate, of 1% by weight of an ethoxylated oleylamine and of 1 g/l of EGS, the pH of the dyebath is adjusted with ammonia to 7–7.5.

For comparison, parallel dyeings are carried out without EGS but with from 0.6 to 1% by weight of acetic acid, at pH 5.

The dyebath (LR 20:1) is entered at 50° C., the temperature is raised to 98° C. in the course of 60 min and maintained at 98° C. for 60 min, which is followed by rinsing. The pH after dyeing is 4.6 in the first case and 6.2 in the comparative case.

General method III is used to prepare the following dyes:

EXAMPLE 5

Dyeing of wool tops (22.1 μm) with 0.18% by weight of a dye of the following constitution:

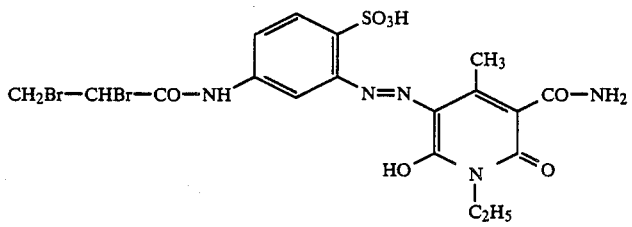

The dyeing with ethylene glycol sulfite is more brilliant than that in the presence of acetic acid.

EXAMPLE 6

Dyeing of wool gabardine with 0.37% by weight of a dye of the following structure:

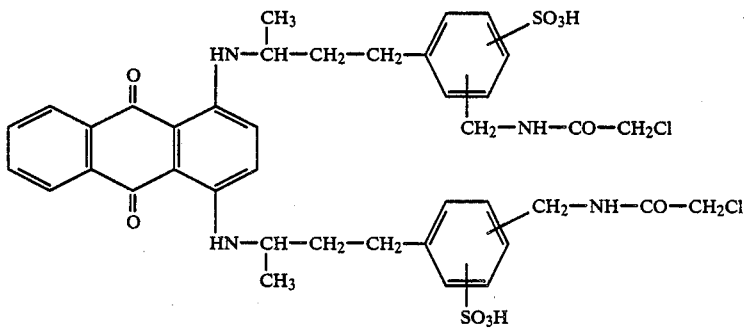

The dyeing with ethylene glycol sulfite is deeper and brighter than the comparison.

IV. Dyeing of wool with 1:2 metal complex dyes

EXAMPLE 7

Dyeing of 36/1-ply yarn on package, cylindrical center LR 10:1. The material is treated at 40° C. with 1% by weight of ethoxylated fatty amine and 5% by weight of ammonium sulfate for 10 min. After addition of 1 g/l of ethylene glycol sulfite, of 0.093% by weight of a dye of the following constitution:

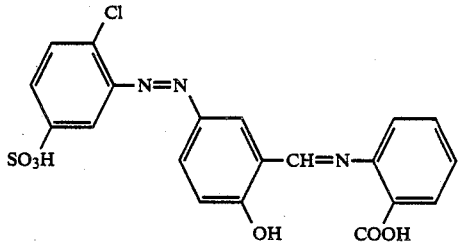

in the form of a 1:2 chromium complex as the trisodium salt of 0.08% by weight of the following dye

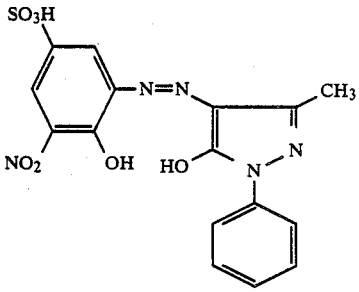

in the form of a chromium (1:2) complex, and of 0.6% by weight of a dye of the following structure:

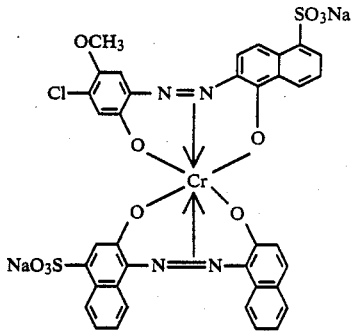

the dyebath is heated up to 75° C. at 1° C./min and then to 100° C. at 0.5° C./min and maintained at 100° C. for 60 min. The pH of 7.1 at the start of the dyeing is 5.2 at the end.

A comparative dyeing is carried out with 1 g/l of ethyl triethanolaminetriacetate as described in DE No. 2,812,039 in place of EGS. It is found that the pH of 7.7 at the start of the dyeing decreases to 6.5 at the end.

To determine the degree of penetration, yarn sections from the outer, middle and inner parts of the dyed package are knitted up side by side. The knitting thus produced shows neither hue nor depth of shade differences. The levelness of the dyeing with EGS is better.

EXAMPLE 8

Dyeing on Hercosett-finished wool yarn (28/2) with 5% by weight of ammonium sulfate, 1% by weight of ethoxylated oleylamine and 1 g/l of EGS.

After addition of the material to be dyed the pH is adjusted to 8.5 with ammonia and 1% by weight of a dye of the following constitution:

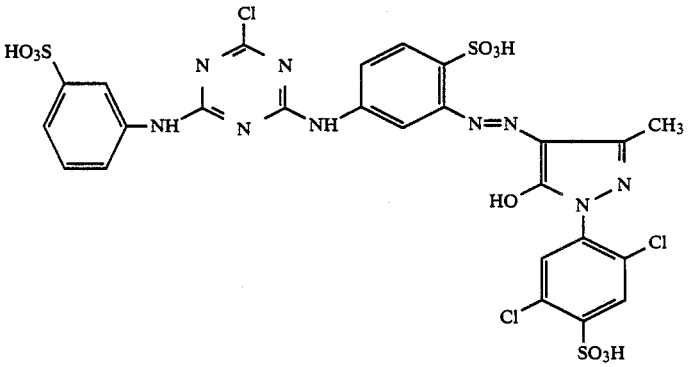

and 1% by weight of a dye of the following structure:

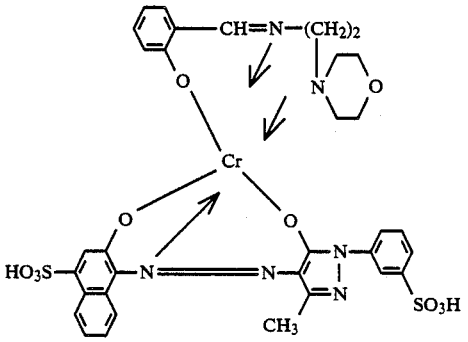

are added.

The bath is raised from 40° C. to 98° C. and maintained at 98° C. for 60 min.

For comparison, parallel dyeings are carried out with 1 g/l of ethyl triethanolaminetriacetate in place of EGS at a starting pH of 7.5.

At the end of the dyeing the pH is 5.0 in the first case and 5.7 in the second case. The presence of EGS results in more brilliant dyeings and better bath exhaustion.

V. Dyeing of nylon

General method:

To dye a nylon fabric at an LR of 20:1, a starting pH of around 7 is set, 0.25 or 0.5 g/l of EGS is added, the temperature is raised from room temperature to 98° C. in the course of 40 min, dyeing is carried out at 98° C. for 30 min, and there is a subsequent rinse. For comparison, a dyeing is carried out without EGS at pH 5.5.

General method V is followed to prepare the following dyeing:

EXAMPLE 9

Dyeing on nylon fabric with 0.2% by weight of C.I. No. 14,172, 0.18% by weight of a dye of the following constitution:

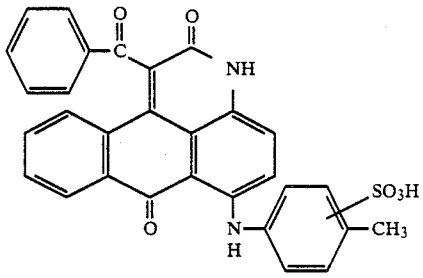

and 0.4% by weight of the following dye:

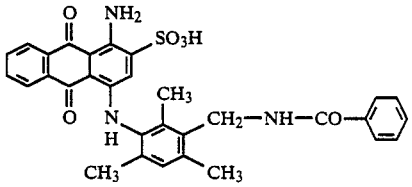

To assess the dyeing, pieces of fabric are removed at various times and dyeings are prepared from the liquor remaining at the end. The rate of dyeing in the presence of ethylene glycol sulfite is very uniform. The pH profile as a function of the temperature in the presence of 0.25 g/l of 0.5 g/l of EGS is shown in the table below:

| T (°C.) | pH (0.25 g/l EGS) | pH (0.5 g/l EGS) |
|---|---|---|
| 25 | 7.2 | 6.9 |
| 40 | 6.5 | 6.3 |
| 50 | 6.0 | 5.7 |
| 60 | 5.7 | 5.4 |
| 70 | 5.6 | 5.2 |
| 80 | 5.4 | 4.9 |
| 90 | 4.7 | 4.4 |
| 98 | 4.3 | 4.1 |

VI. Dyeings of wool with afterchroming dyes

General method:

To dye wool tops having an antifelting finish at a [liquor ratio of 10:1 a starting pH of 7 is set with] 1.5 ml/l of aqueous concentrated ammmonia. 5 g/l of EGS are added. The bath is raised from 40° C. to 100° C. in the course of 90 min and maintained at 100° C. for 20 min. The final pH is 4.2. The bath is then cooled down to 80° C. and formic acid is added to adjust the pH to 3–3.5, which is followed by afterchroming with 1.5% of bichromate on weight of fiber.

EXAMPLE 10

General method VI is followed to prepare the following dyeing:

The following dyes were added to the bath at up to 40° C.:

1.44% by weight of Eriochrom Blackish Blue RN
1.5% by weight of Solochrom Blue 3R
0.078% by weight of Solochrom Violet R Before any formic acid has been added the dyebath is virtually completely exhausted. The resulting dyeing is level.

We claim:

1. A process for dyeing a textile material made of a natural or synthetic polyamide or a mixture thereof with an anionic dye in an aqueous liquor wherein the pH of the aqueous liquor at the start of the dyeing is set to 7–9, comprising dyeing in the presence of a compound of the formula I

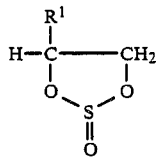

I wherein $R^1$ is hydrogen or alkyl of 1 to 4 carbon atoms, in an amount from 0.25 to 5.0 g/l of liquor.

2. A process as claimed in claim 1, wherein the amount of a compound of formula I added ranges from 0.5 to 2.0 g/l in the dyeing of wool and from 0.25 to 0.5 g/l in the dyeing of nylon.

3. A process as claimed in claim 1, wherein the compound of formula I is ethylene glycol sulfite.

4. A process as claimed in claim 2, wherein the compound of formula I is ethylene glycol sulfite.

* * * * *